US012643753B2

(12) United States Patent
Deura et al.

(10) Patent No.: US 12,643,753 B2
(45) Date of Patent: Jun. 2, 2026

(54) IMAGE RECORDING APPARATUS, CONTROL METHOD OF IMAGE RECORDING APPARATUS, AND NON-TRANSITORY COMPUTER-READABLE STORAGE MEDIUM

(71) Applicant: BROTHER KOGYO KABUSHIKI KAISHA, Nagoya (JP)

(72) Inventors: Yushi Deura, Nagoya (JP); Taisei Okuzono, Nagoya (JP); Haruka Azechi, Nagoya (JP); Yasuhiro Nakano, Nagoya (JP); Gakuro Kanazawa, Toyokawa (JP); Yuki Tsujimura, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 259 days.

(21) Appl. No.: 18/307,100

(22) Filed: Apr. 26, 2023

(65) Prior Publication Data

US 2023/0348218 A1 Nov. 2, 2023

(30) Foreign Application Priority Data

Apr. 28, 2022 (JP) ..... 2022-074135

(51) Int. Cl.
*G06F 3/12* (2006.01)
*B65H 1/04* (2006.01)
(Continued)

(52) U.S. Cl.
CPC ..... *B65H 5/062* (2013.01); *B65H 1/04* (2013.01); *B65H 2404/16* (2013.01); *B65H 2801/15* (2013.01)

(58) Field of Classification Search
CPC . B41J 11/485; B41J 11/48; B41J 11/70; B41J 13/0054; B41J 13/009; B65H 3/44;
(Continued)

(56) References Cited

U.S. PATENT DOCUMENTS 9,375,961 B2 * 6/2016 Hirai ..... G06F 3/1255
2008/0094650 A1 4/2008 Suzuki
(Continued)

FOREIGN PATENT DOCUMENTS

CN 207174978 U 4/2018
JP H1148580 A 2/1999
(Continued)

*Primary Examiner* — Luis A Gonzalez
(74) *Attorney, Agent, or Firm* — Scully, Scott, Murphy & Presser, P.C.

(57) ABSTRACT

An image recording apparatus includes a conveyance mechanism conveying a sheet-shaped medium in a conveyance direction, a recorder recording an image on the conveyed sheet-shaped medium, and a controller. The conveyance mechanism selectively conveys a first sheet-shaped medium accommodated in a first accommodation part, and a second sheet-shaped medium accommodated in a second accommodation part and longer than the first sheet-shaped medium in the conveyance direction. The controller causes, based on a recording command, the conveyance mechanism to convey a sheet-shaped medium from one of the first and second accommodation parts, and causes the recorder to record an image on the sheet-shaped medium. In a case where accommodation part information in the recording command indicates the first accommodation part, and medium information in the recording command indicates the second sheet-shaped medium, the controller causes the conveyance mechanism to convey the second sheet-shaped medium from the second accommodation part.

16 Claims, 8 Drawing Sheets

(51) Int. Cl.
*B65H 3/44* (2006.01)
*B65H 5/06* (2006.01)

(58) Field of Classification Search
CPC . B65H 5/26; B65H 1/04; B65H 1/266; B65H 2511/11; G06K 15/4065; G03G 15/5095; G06F 3/1204; G06F 3/1205; G06F 3/1206; G06F 3/1253; G06F 3/1255; G06F 3/1257; G06F 3/1258; G06F 3/1219
See application file for complete search history.

(56) References Cited

U.S. PATENT DOCUMENTS

2012/0056365 A1* 3/2012 Kato ..... B41J 11/006 271/9.1
2016/0059592 A1* 3/2016 Yasufuku ..... B41J 11/485 347/16
2017/0277986 A1* 9/2017 Hanamura ..... G06K 15/4065
2020/0094591 A1* 3/2020 Lo ..... B41J 13/103
2020/0307928 A1 10/2020 Nuita
2021/0300085 A1* 9/2021 Tsuji ..... B41J 13/0036
2021/0389912 A1* 12/2021 Wakana ..... G06F 3/1234
2022/0212888 A1 7/2022 Tatematsu
2024/0092597 A1* 3/2024 Saito ..... B65H 7/20

FOREIGN PATENT DOCUMENTS

JP 2006044159 A 2/2006
JP 2006337410 A 12/2006
JP 2008123484 A 5/2008
JP 2011031431 A 2/2011
JP 2011108138 A 6/2011
JP 2017068652 A 4/2017
JP 2017208800 A 11/2017
JP 2021054614 A 4/2021

* cited by examiner

FIG. 4

| SIZE INFORMATION (mm) | | | SHEET INFORMATION | TRAY INFORMATION |
|---|---|---|---|---|
| 0<L<210 | 210≤L≤1200 | 1200<L≤2700 | | |
| CUT SHEET | ROLL SHEET | ROLL SHEET | ROLL SHEET | ROLL SHEET |
| CUT SHEET | ROLL SHEET | ROLL SHEET | ROLL SHEET | CUT SHEET |
| CUT SHEET | ROLL SHEET | ROLL SHEET | ROLL SHEET | ANY |
| CUT SHEET | CUT SHEET | ROLL SHEET | CUT SHEET | ROLL SHEET |
| CUT SHEET | CUT SHEET | ROLL SHEET | CUT SHEET | CUT SHEET |
| CUT SHEET | CUT SHEET | ROLL SHEET | CUT SHEET | ANY |
| CUT SHEET | ROLL SHEET | ROLL SHEET | ANY | ROLL SHEET |
| CUT SHEET | CUT SHEET | ROLL SHEET | ANY | CUT SHEET |
| CUT SHEET | (※) | ROLL SHEET | ANY | ANY |

(※) SHEET CORRESPONDING TO PRIORITY INFORMATION
DEFAULT PRIORITY: SIZE INFORMATION > SHEET INFORMATION > TRAY INFORMATION

FIG. 6

| SIZE INFORMATION (mm) | | | SHEET INFORMATION | TRAY INFORMATION |
|---|---|---|---|---|
| 0<L<210 | 210≤L≤1200 | 1200<L≤2700 | | |
| CUT SHEET | ROLL SHEET | ROLL SHEET | ROLL SHEET | ROLL SHEET |
| CUT SHEET | ROLL SHEET | ROLL SHEET | ROLL SHEET | CUT SHEET |
| CUT SHEET | ROLL SHEET | ROLL SHEET | ROLL SHEET | ANY |
| CUT SHEET | ROLL SHEET | ROLL SHEET | CUT SHEET | ROLL SHEET |
| CUT SHEET | CUT SHEET | ROLL SHEET | CUT SHEET | CUT SHEET |
| CUT SHEET | CUT SHEET | ROLL SHEET | CUT SHEET | ANY |
| CUT SHEET | ROLL SHEET | ROLL SHEET | ANY | ROLL SHEET |
| CUT SHEET | CUT SHEET | ROLL SHEET | ANY | CUT SHEET |
| CUT SHEET | (※) | ROLL SHEET | ANY | ANY |

(※) SHEET CORRESPONDING TO PRIORITY INFORMATION
DEFAULT PRIORITY: SIZE INFORMATION > SHEET INFORMATION > TRAY INFORMATION

FIG. 8

| SIZE INFORMATION (mm) | | | | SHEET INFORMATION | TRAY INFORMATION |
|---|---|---|---|---|---|
| 0<L<180 | 180≤L<210 | 210≤L≤1200 | 1200<L≤2700 | | |
| CUT SHEET | ROLL SHEET | ROLL SHEET | ROLL SHEET | ROLL SHEET | ROLL SHEET |
| CUT SHEET | ROLL SHEET | ROLL SHEET | ROLL SHEET | ROLL SHEET | CUT SHEET |
| CUT SHEET | ROLL SHEET | ROLL SHEET | ROLL SHEET | ROLL SHEET | ANY |
| CUT SHEET | ROLL SHEET | CUT SHEET | ROLL SHEET | CUT SHEET | ROLL SHEET |
| CUT SHEET | ROLL SHEET | CUT SHEET | ROLL SHEET | CUT SHEET | CUT SHEET |
| CUT SHEET | ROLL SHEET | CUT SHEET | ROLL SHEET | CUT SHEET | ANY |
| CUT SHEET | ROLL SHEET | ROLL SHEET | ROLL SHEET | ANY | ROLL SHEET |
| CUT SHEET | ROLL SHEET | CUT SHEET | ROLL SHEET | ANY | CUT SHEET |
| CUT SHEET | ROLL SHEET | (※) | ROLL SHEET | ANY | ANY |

(※) SHEET CORRESPONDING TO PRIORITY INFORMATION
DEFAULT PRIORITY: SIZE INFORMATION > SHEET INFORMATION > TRAY INFORMATION

IMAGE RECORDING APPARATUS, CONTROL METHOD OF IMAGE RECORDING APPARATUS, AND NON-TRANSITORY COMPUTER-READABLE STORAGE MEDIUM

REFERENCE TO RELATED APPLICATIONS

This application claims priority from Japanese Patent Application No. 2022-074135 filed on Apr. 28, 2022. The entire content of the priority application is incorporated herein by reference.

BACKGROUND ART

A printer (image recording apparatus) capable of selectively conveying a single sheet (first sheet-shaped medium) accommodated in a first sheet feeding tray (first accommodation part) and a roll sheet (second sheet-shaped medium) accommodated in a second sheet feeding tray (second accommodation part) is known.

When the image recording apparatus capable of selectively conveying a sheet-shaped medium from two accommodation parts executes recording processing based on a recording command, it may be impossible to implement a recording desired by a user if accommodation part information about the accommodation part and medium information about the sheet-shaped medium included in the recording command do not correspond to each other. This may occur, for example, in a case where a driver dedicated to the image recording apparatus is not installed in an external apparatus (a PC, etc.), and a recording command is transmitted to the image recording apparatus based on a general-purpose print function of the external apparatus.

DESCRIPTION

An object of the present disclosure is to provide an image recording apparatus, a control method thereof, and a non-transitory computer-readable storage medium storing a program capable of implementing a recording desired by a user, even in a case where a recording command in which accommodation part information and medium information do not correspond to each other is received, in a configuration that a sheet-shaped medium is selectively conveyed from one of two accommodation parts.

According to a first aspect of the present disclosure, there is provided an image recording apparatus including: a conveyance mechanism configured to convey a sheet-shaped medium in a conveyance direction; a recorder configured to record an image on the sheet-shaped medium conveyed by the conveyance mechanism; and a controller, in which the conveyance mechanism is configured to selectively convey a first sheet-shaped medium accommodated in a first accommodation part, and a second sheet-shaped medium accommodated in a second accommodation part and longer than the first sheet-shaped medium in the conveyance direction, and in which the controller is configured to: cause, based on a recording command, the conveyance mechanism to convey a sheet-shaped medium from one of the first accommodation part and the second accommodation part, and cause the recorder to record an image on the sheet-shaped medium; and cause the conveyance mechanism to convey the second sheet-shaped medium from the second accommodation part, in a case where accommodation part information about an accommodation part included in the recording command indicates the first accommodation part and medium information about a sheet-shaped medium included in the recording command indicates the second sheet-shaped medium.

According to a second aspect of the present disclosure, there is provided a control method of an image recording apparatus including a conveyance mechanism configured to convey a sheet-shaped medium in a conveyance direction, and a recorder configured to record an image on the sheet-shaped medium conveyed by the conveyance mechanism, the conveyance mechanism being configured to selectively convey a first sheet-shaped medium accommodated in a first accommodation part, and a second sheet-shaped medium accommodated in a second accommodation part and longer than the first sheet-shaped medium in the conveyance direction, the control method including: causing, based on a recording command, the conveyance mechanism to convey a sheet-shaped medium from one of the first accommodation part and the second accommodation part, and causing the recorder to record an image on the sheet-shaped medium; and causing the conveyance mechanism to convey the second sheet-shaped medium from the second accommodation part, in a case where accommodation part information about an accommodation part included in the recording command indicates the first accommodation part and medium information about a sheet-shaped medium included in the recording command indicates the second sheet-shaped medium.

According to a third aspect of the present disclosure, there is provided a non-transitory computer-readable storage medium storing a program executable by a computer of an image recording apparatus that includes a conveyance mechanism configured to convey a sheet-shaped medium in a conveyance direction, and a recorder configured to record an image on the sheet-shaped medium conveyed by the conveyance mechanism, the conveyance mechanism being configured to selectively convey a first sheet-shaped medium accommodated in a first accommodation part, and a second sheet-shaped medium accommodated in a second accommodation part and longer than the first sheet-shaped medium in the conveyance direction, the program including instructions that, when executed by the computer, cause the image recording apparatus to perform: causing, based on a recording command, the conveyance mechanism to convey a sheet-shaped medium from one of the first accommodation part and the second accommodation part, and causing the recorder to record an image on the sheet-shaped medium; and causing the conveyance mechanism to convey the second sheet-shaped medium from the second accommodation part, in a case where when accommodation part information about an accommodation part included in the recording command indicates the first accommodation part and medium information about a sheet-shaped medium included in the recording command indicates the second sheet-shaped medium.

According to the present disclosure, in the case where a recording command in which the accommodation part information and the medium information do not correspond to each other is received, it is possible to implement a recording desired by a user by giving priority to the medium information.

FIG. 4 shows a table stored in a ROM of the printer of FIG. 1.

FIG. 6 shows a table stored in the ROM of the printer.

FIG. 8 shows a table stored in the ROM of the printer.

FIRST EMBODIMENT

Figure 1:
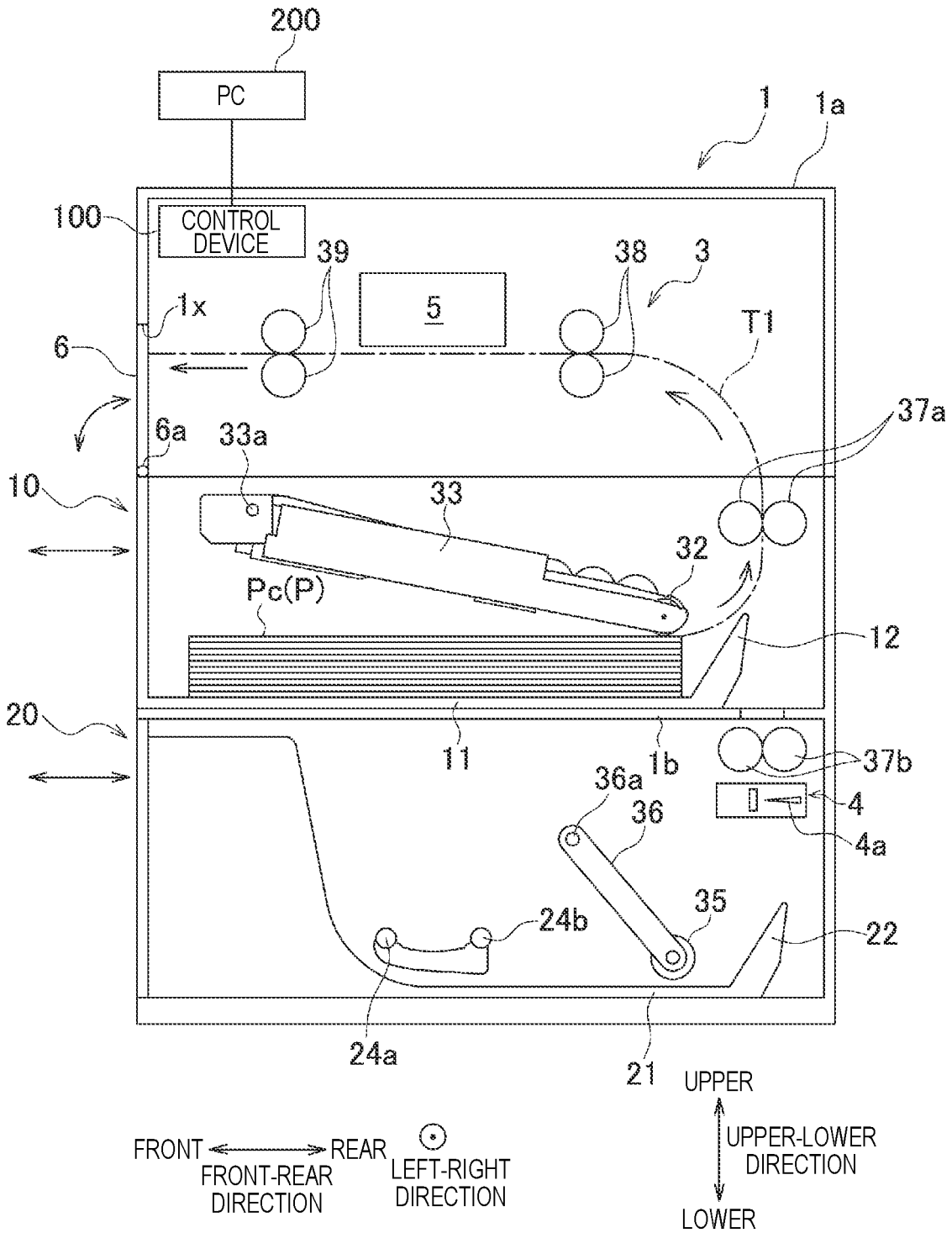
FIG. 1 is a schematic side view showing an internal structure of a printer in a state where cut sheets are accommodated.
Figure 2:
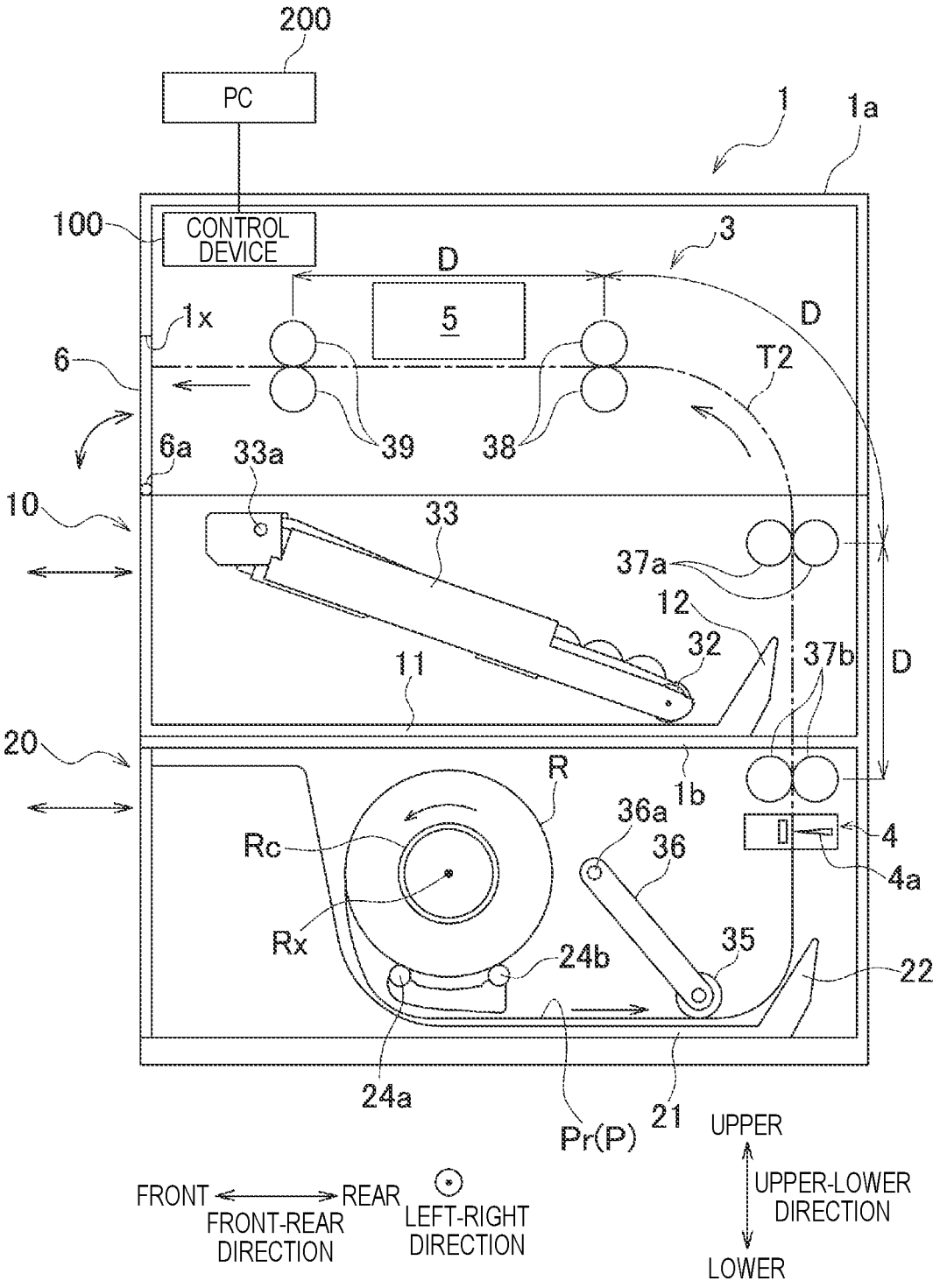
FIG. 2 is a schematic side view showing an internal structure of the printer in a state where a roll body is accommodated in the printer of FIG. 1.

As shown in FIGS. 1 and 2, a printer 1 (image recording apparatus) according to a first embodiment of the present disclosure includes a housing 1*a*, sheet feeding trays 10 and 20 detachably mounted to the housing 1*a*, and a sheet discharge tray 6. The sheet feeding tray 10 corresponds to the "first accommodation part" of the present disclosure, and the sheet feeding tray 20 corresponds to the "second accommodation part" of the present disclosure.

The sheet feeding trays 10 and 20 have a box shape opening upward and are movable in a front-rear direction with respect to the housing 1*a*. The sheet feeding trays 10 and 20 are pulled out of the housing 1*a* by moving forward with respect to the housing 1*a*, and are mounted to the housing 1*a* by moving rearward with respect to the housing 1*a*. The sheet feeding trays 10 and 20 can take mount positions (refer to FIGS. 1 and 2) at which they are mounted to the housing 1*a* and pull-out positions (not shown) ahead of the mount positions. When the sheet feeding trays 10 and 20 are at the mount positions, the sheet feeding tray 10 overlaps the sheet feeding tray 20 in an upper-lower direction and is arranged above the sheet feeding tray 20.

The sheet discharge tray 6 is constituted by a sidewall of an upper front part of the housing 1*a*. The sheet discharge tray 6 can take an open position (not shown) for opening an opening 1*x* of the housing 1*a* and a closed position for closing the opening 1*x* (refer to FIGS. 1 and 2) by rotating about a shaft 6*a* along a left-right direction.

The printer 1 further includes a conveyance mechanism 3, a cutting mechanism 4, a head 5, and a control device 100. Elements of the conveyance mechanism 3 except rollers 24*a* and 24*b* described later, the cutting mechanism 4, the head 5, and the control device 100 are supported by the housing 1*a*.

The conveyance mechanism 3 is configured to selectively convey a sheet P from the sheet feeding trays 10 and 20, and includes rollers 24*a* and 24*b*, rollers 32 and 35 and arms 33 and 36, pairs of rollers 37*a*, 37*b*, 38 and 39, and a conveying motor 30 (refer to FIG. 3) for driving each of the rollers.

The sheet P is a general term for a cut sheet Pc (refer to FIG. 1) and a roll sheet Pr (refer to FIG. 2), and corresponds to the "sheet-shaped medium" of the present disclosure. The cut sheet Pc corresponds to the "first sheet-shaped medium" of the present disclosure, and the roll sheet Pr corresponds to the "second sheet-shaped medium" of the present disclosure. The cut sheet Pc is shorter than the roll sheet Pr in a conveyance direction (a direction in which the sheet P is conveyed by the conveyance mechanism 3). In other words, a length of the conveyance direction in a size (second size) of the roll sheet Pr is longer than a length of the conveyance direction in a size (first size) of the cut sheet Pc. For example, in the case of A4 size, when the cut sheet Pc is placed (placed horizontally) on the sheet feed tray 10 so that its longitudinal direction is along the left-right direction, the length of the cut sheet in the conveyance direction is 210 mm. In addition, in the case of A3 size, when the cut sheet Pc is placed (placed horizontally) on the sheet feed tray 10 so that its longitudinal direction is along the left-right direction, the length of the cut sheet in the conveyance direction is 420 mm. The length, in the conveyance direction, of the roll sheet Pr in the brand-new roll body R is, for example, 900 mm, 1200 mm, 2700 mm or the like. The "second sheet-shaped medium" of the present disclosure is longer than the "first sheet-shaped medium" (e.g., A size or B size) of the present disclosure in the conveyance direction.

In the conveyance mechanism 3, the roller 32 and the arm 33, and the pairs of rollers 37*a*, 38, and 39 constitute a conveyance path T1 along which the cut sheet Pc is conveyed from the sheet feeding tray 10 to the sheet discharge tray 6 through the lower side of the head 5 (refer to FIG. 1). In the conveyance mechanism 3, the rollers 24*a* and 24*b*, the roller 35 and arm 36, and the pairs of rollers 37*a*, 37*b*, 38, 39 constitute a conveyance path T2 along which the roll sheet Pr is conveyed from the sheet feeding tray 20 to the sheet discharge tray 6 through a lower of the of the head 5 (refer to FIG. 2). A part from the pair of rollers 37*a* to the sheet discharge tray 6 in the conveyance paths T1 and T2 is common.

The pairs of rollers 37*a*, 37*b*, 38, and 39 are spaced apart from each other in the conveyance direction, and convey the sheet P in the conveyance direction by rotating while sandwiching the sheet P. As shown in FIG. 2, an interval D between the pair of rollers 37*a* and the pair of rollers 37*b* in the conveyance direction, an interval D between the pair of rollers 37*a* and the pair of rollers 38 in the conveyance direction, and an interval D between the pair of rollers 38 and the pair of rollers 39 in the conveyance direction are equal to each other. The length (for example, 210 mm when the cut sheet is of an A4 size and placed horizontally) of the cut sheet Pc in the conveyance direction is equal to or longer than the interval D (for example, 180 mm).

As shown in FIG. 1, the sheet feeding tray 10 enables to accommodate a plurality of cut sheets Pc stacked in the upper-lower direction. The cut sheet Pc is supported on an upper surface of a bottom wall 11 of the sheet feeding tray 10.

When no cut sheet Pc is accommodated in the sheet feeding tray 10 in a state in which the sheet feeding tray 10 is mounted to the housing 1*a*, the roller 32 is in contact with the bottom wall 11 (refer to FIG. 2). When the cut sheet Pc is accommodated in the sheet feeding tray 10 in a state in which the sheet feeding tray 10 is mounted to the housing 1*a*, the roller 32 is in contact with the uppermost cut sheet Pc (refer to FIG. 1). In this state, when the conveying motor 30 (refer to FIG. 3) is driven under control of the control device 100, the roller 32 rotates and the cut sheet Pc is fed rearward.

The roller 32 is supported by one end of the arm 33. The other end of the arm 33 is supported by the housing 1*a* via a shaft 33*a* along the left-right direction. The arm 33 is rotatable about the shaft 33*a* (refer to FIGS. 1 and 2). The arm 33 is urged by an urging member (not shown) so that the roller 32 is in close to the bottom wall 11.

As shown in FIG. 2, the sheet feeding tray 20 enables to accommodate a roll body R. The roll body R has a configuration where the long roll sheet Pr is rolled in a roll shape on an outer peripheral surface of a cylindrical core member Rc. The roll body R is accommodated in the sheet feeding tray 20 with its rotational axis Rx (central axis of the core member Rc) extending in the left-right direction.

At a bottom part of the sheet feeding tray 20, the rollers 24*a* and 24*b* are arranged. The rollers 24*a* and 24*b* are each rotatable about an axis along the left-right direction. When the roll body R is accommodated in the sheet feeding tray 20, an outer peripheral surface of a lower part of the roll body is supported by the rollers 24*a* and 24*b*.

When setting the roll body R, the roll body R is manually rotated in a counterclockwise direction in FIG. 2 to unwind the roll sheet Pr from the roll body R. Then, a tip end of the roll sheet Pr is sandwiched between the roller 35 and a bottom wall 21 of the sheet feeding tray 20. In this state, when the conveying motor 30 (refer to FIG. 3) is driven under control of the control device 100, the rollers 24*a*, 24*b* and 35 rotate, and the roll sheet Pr is fed rearward. The roll sheet Pr fed from the sheet feeding tray 20 by the roller 35 comes into contact with a sidewall 22 at the rear of the sheet feeding tray 20, moves along the sidewall 22, and is guided to the cutting mechanism 4.

The roller 35 is supported by one end of the arm 36. The other end of the arm 36 is supported by the housing 1*a* via a shaft 36*a* along the left-right direction. The arm 36 is rotatable about the shaft 36*a*. The arm 36 is urged by an urging member (not shown) so that the roller 35 is in close to the bottom wall 21.

Figure 3:
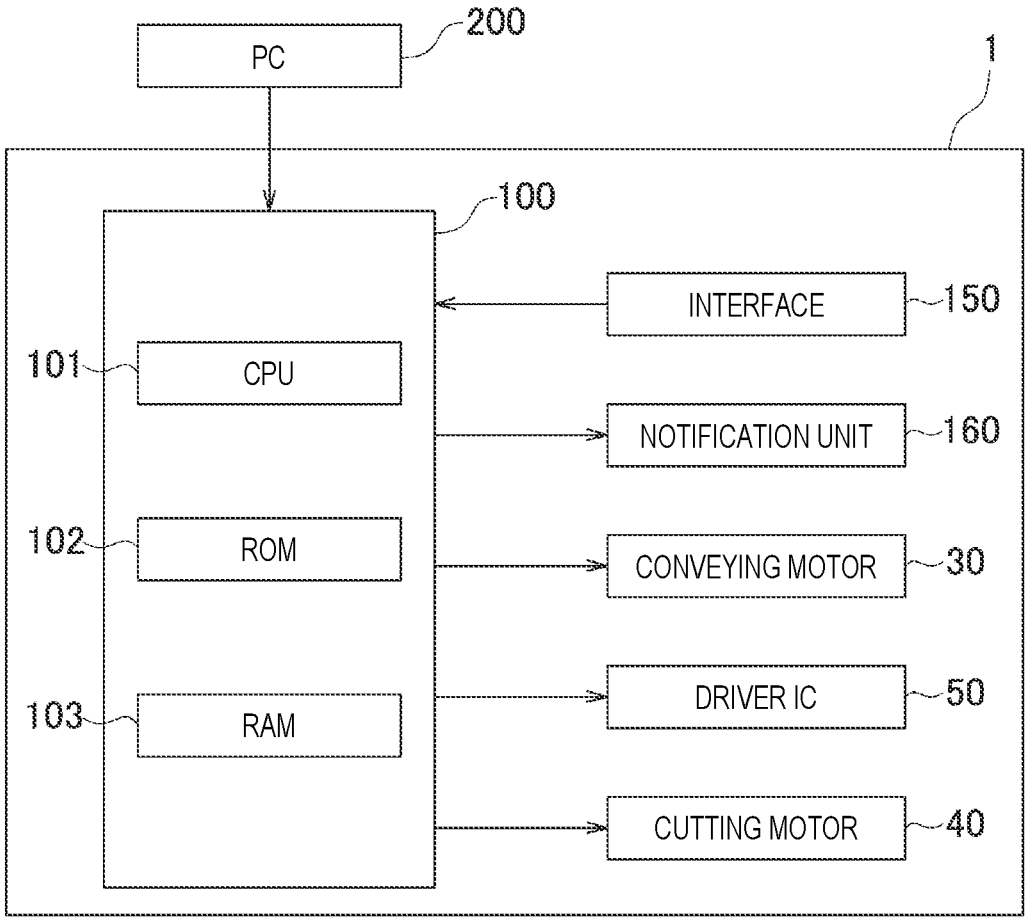
FIG. 3 is a block diagram showing an electrical configuration of the printer of FIG. 1.

The cutting mechanism 4 includes a cutter 4*a* and a cutting motor 40 (refer to FIG. 3). The cutter 4*a* is arranged above the sidewall 22 at the rear of the sheet feeding tray 20 and below the pair of rollers 37*b*. The cutter 4*a* consists of, for example, a disk-shaped rotary blade and a driven blade. Alternatively, the cutter 4*a* may consist of a rotary blade and a fixed blade. When the cutting motor 40 is driven under control of the control device 100, the rotary blade reciprocates in the left-right direction while rotating. The length of the roll sheet Pr in the conveyance direction can be adjusted by being cut in the left-right direction (a direction intersecting with the conveyance direction) by the cutter 4*a*.

The head 5 (corresponds to the "recorder" of the present disclosure) is of an inkjet type, and has a plurality of nozzles (not shown) formed in a lower surface. When the sheet P conveyed by the conveyance mechanism 3 passes through a position facing the lower surface of the head 5, a driver IC 50 (refer to FIG. 3) is driven under control of the control device 100, so that ink is ejected from the nozzles and lands on the sheet P, and accordingly, an image is recorded on the sheet P. Note that, the head 5 may be whichever one of a line-type configured to eject the ink from the nozzles in a state where a position is fixed and a serial-type configured to eject the ink from the nozzles while moving in the right and left direction.

As shown in FIG. 3, the control device 100 is connected to an interface 150, a notification unit 160, the conveying motor 30, the driver IC 50, and the cutting motor 40 via an internal bus (not shown). The interface 150 is an element for a user of the printer 1 to perform an input, and is constituted by, for example, a switch, a button, a keyboard, a mouse, a touch panel and the like. The notification unit 160 is an element for performing a notification to the user, and is constituted by, for example, a display for outputting an image or a speaker for outputting audio.

The control device 100 is further communicatively connected to a PC (Personal Computer) 200. The PC 200 does not have a driver dedicated to the printer 1 installed, and has a general-purpose print function.

The control device 100 has a CPU (Central Processing Unit) 101, a ROM (Read Only Memory) 102 and a RAM (Random Access Memory). The CPU 101 corresponds to the "controller" of the present disclosure, and the RAM 103 corresponds to the "memory" of the present disclosure.

In the ROM 102, programs and data for the CPU 101 to control various operations are stored. The RAM 103 temporarily stores data that is used at the time when the CPU 101 executes the programs. The control device 100 executes recording processing of, based on a recording command received from the PC 200 and data input from the interface 150, controlling the conveying motor 30 and the driver IC 50 (further, the cutting motor 40 when performing recording on the roll sheet Pr) to record an image on the sheet P, according to the programs and data stored in the ROM 102 and the RAM 103.

In addition to the image data, the recording command includes "size information" about a size of the sheet P, "sheet information" about the sheet P (corresponding to "medium information" in the present disclosure), and "tray information" about the sheet feeding trays 10 and 20 (corresponds to "accommodation part information" of the present disclosure). The "size information" is information indicating a size (including a length in the conveyance direction) of the sheet P that is a target of the recording processing. The "sheet information" is information indicating whether the sheet P that is a target of the recording processing is the roll sheet Pr, the cut sheet Pc, or any (any: whichever one of the roll sheet Pr and the cut sheet Pc may be selected). The "tray information" is information indicating whether to convey the roll sheet Pr from the sheet feeding tray 20, the cut sheet Pc from the sheet feeding tray 10 or any (any: the sheet P may be conveyed from either of the sheet feeding trays 10, 20).

The data that is input from the interface 150 includes "priority information" indicating which of the sheet feeding trays 10 and 20 is given priority.

In the ROM 102, a table indicating a type of a sheet P that is selected as a target of recording processing according to "size information", "sheet information" and "tray information" as shown in FIG. 4 (refer to FIG. 4: any of the cut sheet Pc and the roll sheet Pr) is stored. The default priority is set to be "size information>tray information>sheet information".

The RAM 103 temporarily stores the recording command received from the PC 200 and the data input from the interface 150.

When the CPU 101 receives the recording command from the PC 200, the CPU selects, based on the table stored in the ROM 102 and the data read out from the RAM 103, any of the cut sheet Pc and the roll sheet Pr, as a target of the recording processing, and executes the recording processing on the selected sheet P. Note that there is a case in which "sheet information" or "tray information" is not included in the recording command. In this case, the CPU 101 performs processing, assuming that the information is 'any'.

Figure 5:
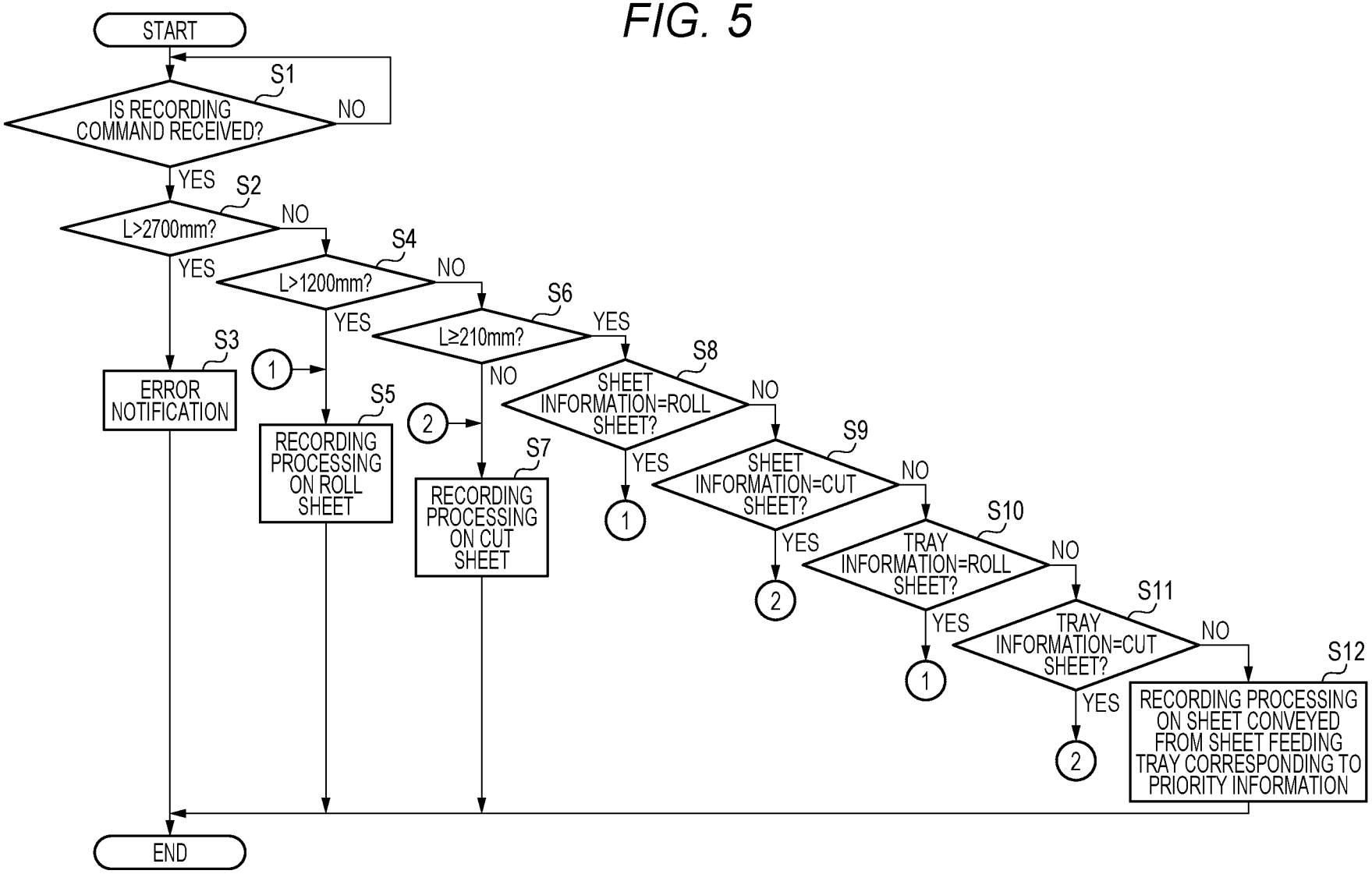
FIG. 5 is a flowchart showing processing that is executed by a CPU of the printer of FIG. 1.

Alternatively, the CPU 101 may execute a program shown in FIG. 5.

In FIG. 5, the CPU 101 first determines whether a recording command has been received from the PC 200 (S1).

If it is determined that the recording command has not been received from the PC 200 (S1: NO), the CPU 101 repeats the processing of S1.

If it is determined that the recording command has been received from the PC 200 (S1: YES), the CPU 101 determines whether the length L in the conveyance direction indicated by the size information included in the recording command exceeds 2700 mm (L>2700 mm) (S2).

If it is determined that L>2700 mm is (S2: YES), the CPU 101 issues an error notification indicating that recording is impossible, via the notification unit 160 (refer to FIG. 3)

(S3). This is because, as described above, the length, in the conveyance direction, of the roll sheet Pr of the brand-new roll body R is 2700 mm, the length, in the conveyance direction, of the cut sheet Pc is shorter than that of the roll sheet Pr, and therefore, recording corresponding to 'L>2700 mm' cannot be implemented even when any of the cut sheet Pc and the roll sheet Pr is selected. After S3, the CPU 101 ends the program.

If it is determined that L>2700 mm is not (S2: NO), the CPU 101 determines whether L>1200 mm is (S4).

If it is determined that L>1200 mm is (S4: YES), the CPU 101 performs recording processing on the roll sheet Pr (S5). In S5, the CPU 101 causes the conveyance mechanism 3 to convey the roll sheet Pr along the conveying path T2 from the sheet feeding tray 20 (refer to FIG. 2), causes the head 5 to eject ink to the roll sheet Pr, and causes the cutting mechanism 4 to cut the roll sheet Pr into a predetermined length. After S5, the CPU 101 ends the program.

If it is determined that L>1200 mm is not (S4: NO), the CPU 101 determines whether L≥210 mm is (S6).

If it is determined that L≥210 mm is not (i.e., L<210 mm) (S6: NO), the CPU 101 performs recording processing on the cut sheet Pc (S7). In S7, the CPU 101 causes the conveyance mechanism 3 to convey the cut sheet Pc along the conveyance path T1 from the sheet feed tray 10 (refer to FIG. 1), and causes the head 5 to eject ink to the cut sheet Pc. After S7, the CPU 101 ends the program.

If it is determined that L≥210 mm is (S6: YES), the CPU 101 determines whether the sheet information included in the recording command indicates the roll sheet Pr (S8).

If it is determined that the sheet information indicates the roll sheet Pr (S8: YES), the CPU 101 performs recording processing on the roll sheet Pr (S5).

If it is determined that the sheet information does not indicate the roll sheet Pr (S8: NO), the CPU 101 determines whether the sheet information indicates the cut sheet Pc (S9).

If it is determined that the sheet information indicates the cut sheet Pc (S9: YES), the CPU 101 performs recording processing on the cut sheet Pc (S7).

If it is determined that the sheet information does not indicate the cut sheet Pc (i.e., the sheet information indicates whichever one of the roll sheet Pr and the cut sheet Pc may be selected) (S9: NO), the CPU 101 determines whether the tray information included in the recording command indicates the roll sheet Pr (indicates that the roll sheet Pr is to be conveyed from the sheet feed tray 20 in the recording processing) (S10).

If it is determined that the tray information indicates the roll sheet Pr (S10: YES), the CPU 101 performs recording processing on the roll sheet Pr (S5).

If it is determined that the tray information does not indicate the roll sheet Pr (S10: NO), the CPU 101 determines whether the tray information indicates the cut sheet Pc (S11).

If it is determined that the tray information indicates the cut sheet Pc (S11: YES), the CPU 101 performs recording processing on the cut sheet Pc (S7).

If it is determined that the tray information does not indicate the cut sheet Pc (i.e., indicates that the sheet P may be conveyed from either of the sheet feeding trays 10, 20) (S11: NO), the CPU 101 performs recording processing on the sheet P conveyed from a sheet feeding tray corresponding to the "priority information" input from the interface 150 (S12). After S12, the CPU 101 ends the program.

Note that the CPU 101 makes recording control (color parameter, presence or absence of edge, etc.) different in S5 (recording processing on the roll sheet Pr) and S7 (recording processing on the cut sheet Pc). The color parameter is a parameter of a lookup table for converting image data (RGB (red, green, blue) data corresponding to a color of an image) into ejection data (CMYK data corresponding to colors of ink). In S7 (recording processing on the cut sheet Pc), the recording control is made different according to whether the cut sheet Pc to be recorded is a plain sheet, a glossy sheet or the like.

As described above, according to the present embodiment, when the tray information indicates the sheet feeding tray 10 (cut sheet Pc) and the sheet information indicates the roll sheet Pr, the CPU 101 causes the conveyance mechanism 3 to convey the roll sheet Pr from the sheet feeding tray 20 (refer to the second row from the top in the size information "210 mm≤L≤1200 mm" in FIG. 4, S8: YES→S5 in FIG. 5). In this case, in the configuration in which the sheet P can be conveyed selectively from the two sheet feeding trays 10 and 20, even when a recording command in which the tray information and the medium information do not correspond to each other is received, the recording desired by the user can be implemented.

When the tray information indicates the sheet feeding tray 20 (roll sheet Pr) and the sheet information indicates the cut sheet Pc, the CPU 101 causes the conveyance mechanism 3 to convey the cut sheet Pc from the sheet feeding tray 10 (refer to the fourth row from the top in the size information "210 mm≤L≤1200 mm" in FIG. 4, S9: YES→S7 in FIG. 5). In this case, in the configuration in which the sheet P can be conveyed selectively from the two sheet feeding trays 10 and 20, even when a recording command in which the tray information and the medium information do not correspond to each other is received, the recording desired by the user can be implemented.

When the sheet information indicates any (any: whichever one of the roll sheet Pr and the cut sheet Pc may be selected), or when the sheet information is not included in the recording command, the CPU 101 causes the conveyance mechanism 3 to convey the sheet P from the sheet feeding tray indicated by the tray information (refer to the second and third rows from the bottom in the size information "210 mm≤L≤1200 mm" in FIG. 4, S9: NO→S10, S11 in FIG. 5). In this case, when the sheet information indicates 'any' or when the sheet information is not included in the recording command, the tray information is adopted, so that the recording desired by the user can be implemented.

When both the sheet information and the tray information indicate 'any' (any: whichever one of the roll sheet Pr and the cut sheet Pc may be selected), or when the sheet information and the tray information are not included in the recording command, the CPU 10 causes the sheet P to be conveyed from the sheet feeding tray corresponding to the priority information (refer to the first row from the bottom in the size information "210 mm≤L≤1200 mm" in FIG. 4, S11: NO→S12 in FIG. 5). In this case, the priority information is adopted, so that the recording desired by the user can be implemented.

When the size information indicates a size in which a length of the conveyance direction in the size is longer than that of the cut sheet Pc, the CPU 101 causes the conveyance mechanism 3 to convey the roll sheet Pr from the sheet feeding tray 20 (refer to the rows in the size information "1200 mm≤L≤2700 mm" in FIG. 4, S4: YES→S5 in FIG. 5). If the cut sheet Pc is conveyed in the above case of the size information, since the length of the cut sheet Pc in the conveyance direction (for example, 210 mm when the cut sheet is of an A4 size and placed horizontally) is shorter than that indicated in the size information included in the recording command, the recording desired by the user cannot be implemented. In this respect, in the present embodiment, the roll sheet Pr is conveyed in the above case of the size information, so that the recording desired by the user can be implemented.

When the size information indicates a size in which a length of the conveyance direction in the size is shorter than that of the cut sheet Pc, the CPU 101 causes the conveyance mechanism 3 to convey the cut sheet Pc from the sheet feeding tray 10 (refer to the rows in the size information "0 mm<L<210 mm in FIG. 4, S6: NO→S7 in FIG. 5). In this case, by conveying a cut sheet Pc having a size close to the size desired by the user, the recording desired by the user can be implemented.

The length of the cut sheet Pc in the conveyance direction (for example, 210 mm when the cut sheet is of an A4 size and placed horizontally) is equal to or longer than the interval D (for example, 180 mm) of the pairs of rollers 37*a*, 37*b*, 38, and 39 in the conveyance direction. When the size information indicates a size (third size: for example, L=150 mm) in which a length of the conveyance direction in the size is shorter than the interval D, the CPU 101 causes the conveyance mechanism 3 to convey the cut sheet Pc from the sheet feeding tray 10 (refer to the rows in the size information "0 mm<L<210 mm in FIG. 4, S6: NO→S7 in FIG. 5). If the roll sheet Pr is conveyed and the cutter 4*a* is caused to cut the roll sheet Pr into the third size when the size information indicates the third size, a length, in the conveyance direction, of a sheet P created by the cutting becomes shorter than the interval D, so that the sheet P cannot be conveyed by the pairs of rollers 37*a*, 37*b*, 38, and 39. In this respect, in the present embodiment, when the size information indicates the third size, the cut sheet Pc is conveyed. Thereby, the problem that the sheet P cannot be conveyed by the pair of rollers 37*a*, 37*b*, 38, and 39 can be suppressed.

SECOND EMBODIMENT

A printer (image recording apparatus) according to a second embodiment of the present disclosure is different from the first embodiment, in terms of control contents.

In the first embodiment (refer to FIGS. 4 and 5), when the tray information indicates the sheet feeding tray 20 (roll sheet Pr) and the sheet information indicates the cut sheet Pc, the CPU 101 causes the conveyance mechanism 3 to convey the cut sheet Pc from the sheet feeding tray 10 (refer to the fourth row from the top in the size information "210 mm≤L≤1200 mm" in FIG. 4, S9: YES→S7 in FIG. 5).

In contrast, in the second embodiment (refer to FIG. 6), when the tray information indicates the sheet feeding tray 20 (roll sheet Pr) and the sheet information indicates the cut sheet Pc, the CPU 101 causes the conveyance mechanism 3 to convey the roll sheet Pr from the sheet feeding tray 20 (refer to the fourth row from the top in the size information "210 mm≤L≤1200 mm" in FIG. 6).

Figure 7:
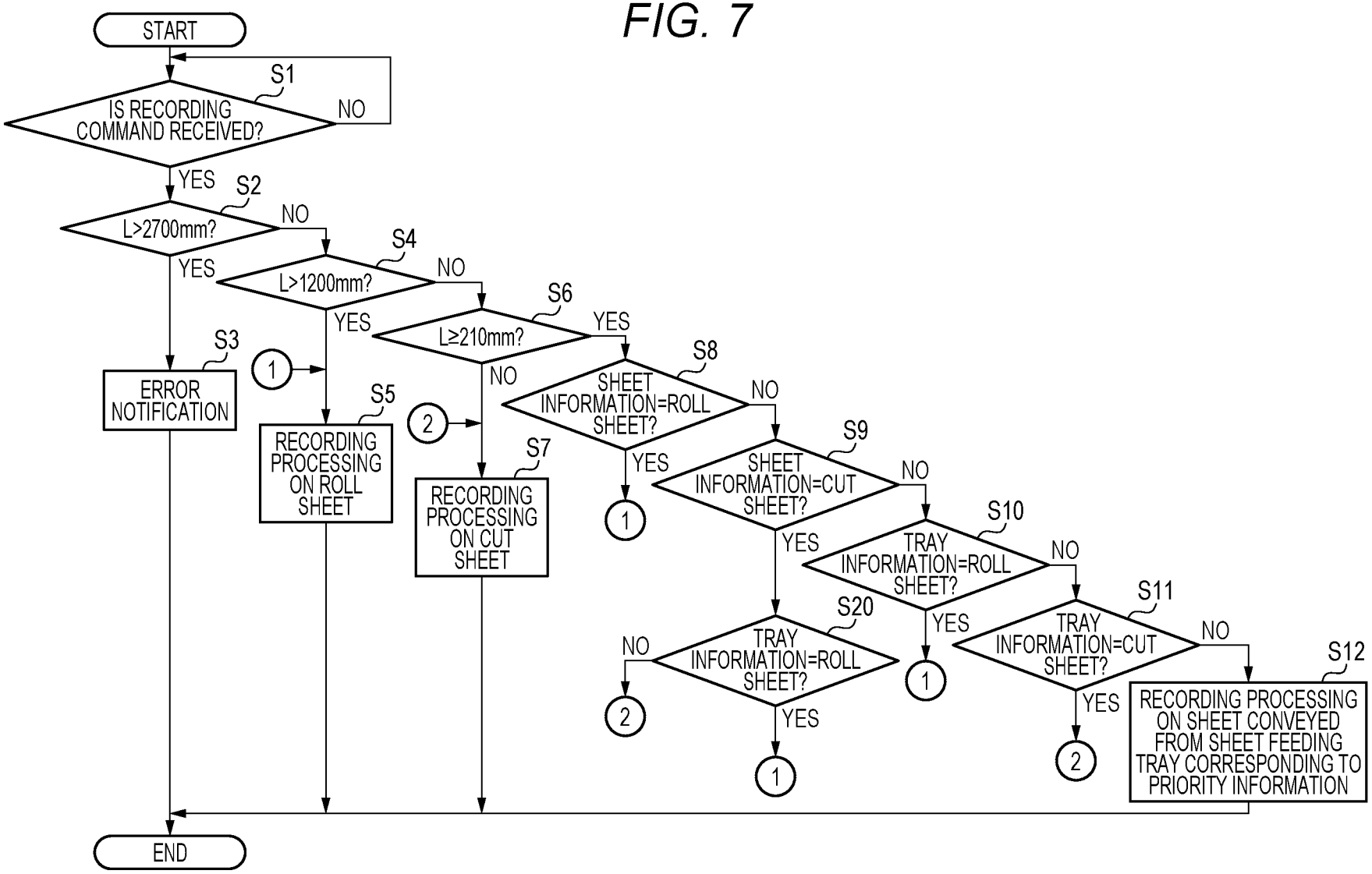
FIG. 7 is a flowchart showing processing that is executed by the CPU of the printer.

In the second embodiment, as shown in FIG. 7, when it is determined that the sheet information indicates the cut sheet Pc (S9: YES), the CPU 101 does not immediately advance the processing to S7, but determines whether the tray information indicates the roll sheet Pr (S20). If it is determined that the tray information indicates the roll sheet Pr (S20: YES), the recording processing is performed on the roll sheet Pr (S5). If it is determined that the tray information does not indicate the roll sheet Pr (S20: NO), the recording processing is performed on the cut sheet Pc (S7).

According to the present embodiment, in the configuration in which the sheet P can be conveyed selectively from the two sheet feeding trays 10 and 20, even when a recording command in which the tray information and the medium information do not correspond to each other is received, the recording desired by the user can be implemented.

THIRD EMBODIMENT

A printer (image recording apparatus) according to a third embodiment of the present disclosure is different from the first embodiment, in terms of control contents.

In the first embodiment (refer to FIG. 4), the CPU 101 causes the cut sheet Pc to be conveyed in the case of "L<210 mm".

In contrast, in the third embodiment (refer to FIG. 8), in the case of "L<210 mm", the CPU 101 further determines whether "L<180 mm" or "L≥180 mm". In the case of "L<180 mm", the CPU causes the cut sheet Pc to be conveyed, and in the case of "L≥180 mm", the CPU causes the cutter 4*a* to cut the roll sheet Pr, thereby creating a sheet of a size (180 mm≤L≤210 mm) corresponding to the size information.

Here, "180 mm≤L≤210 mm" is a length, in the conveyance direction, of the "fourth size" according to the present disclosure, is shorter than a length (for example, 210 mm when the sheet is of an A4 size and placed horizontally), in the conveyance direction, of the size (first size) of the cut sheet Pc, and is equal to or longer than the interval D (for example, 180 mm), in the conveyance direction, of the pairs of rollers 37*a*, 37*b*, 38, and 39.

According to the present embodiment, when the size information indicates a size (180 mm≤L<210 mm) in which a length of the conveyance direction in the size is equal to or longer than the interval D and shorter than the cut sheet Pc, the roll sheet Pr is used, and the length, in the conveyance direction, of the roll sheet Pr is adjusted by cutting, so that the recording desired by the user can be implemented. In this case, since the length L, in the conveyance direction, of the sheet P created by cutting is equal to or longer than the interval D, the problem that the sheet P cannot be conveyed by the pairs of rollers 37*a*, 37*b*, 38, and 39 does not occur.

MODIFIED EMBODIMENTS

While the invention has been described in conjunction with various example structures outlined above and illustrated in the figures, various alternatives, modifications, variations, improvements, and/or substantial equivalents, whether known or that may be presently unforeseen, may become apparent to those having at least ordinary skill in the art. Accordingly, the example embodiments of the disclosure, as set forth above, are intended to be illustrative of the invention, and not limiting the invention. Various changes may be made without departing from the spirit and scope of the disclosure. Therefore, the disclosure is intended to embrace all known or later developed alternatives, modifications, variations, improvements, and/or substantial equivalents.

In the above embodiments, the second sheet-shaped medium is the roll sheet Pr, but is not limited thereto, and may be, for example, a sheet folded into a bellows shape.

The accommodation part is not limited to the tray. For example, when a sheet folded into a bellows shape is placed on the bottom, a space where the sheet is placed corresponds to the accommodation part.

In the three or more pairs of rollers, the interval in the conveyance direction between the pair of rollers adjacent to each other in the conveyance direction may not be constant. In this case, the length of the conveyance direction in the first size may be set equal to or longer than an minimum interval, the length of the conveyance direction in the third size may be set shorter than the minimum interval, and the length of the conveyance direction in the fourth size may be set equal to or longer than the minimum interval.

The sheet-shaped medium is not limited to paper, but may also be cloth or plastic film. That is, the sheet-shaped medium may be made of any material as long as it has a sheet shape.

The recorder may also eject liquid other than the ink (for example, treatment liquid that aggregates or precipitates components in the ink) when it is of a liquid discharge type. Also, the recorder is not limited to a liquid discharge type, and may also be of a laser type, a thermal transfer type or the like.

The present invention is not limited to the printer, and can also be applied to a facsimile, a copier, a complex machine, and the like.

The program according to the present disclosure can be distributed with being recorded on a removable recording medium such as a flexible disk or a fixed recording medium such as a hard disk, as well as can be distributed via a communication line.

What is claimed is:

1. An image recording apparatus comprising:

a conveyance mechanism configured to convey a sheet-shaped medium in a conveyance direction;

a recorder configured to record an image on the sheet-shaped medium conveyed by the conveyance mechanism; and a controller, wherein the conveyance mechanism is configured to selectively convey a first sheet-shaped medium accommodated in a first accommodation part, and a second sheet-shaped medium accommodated in a second accommodation part and longer than the first sheet-shaped medium in the conveyance direction, and wherein the controller is configured to:

cause, based on a recording command received from an external device, the conveyance mechanism to convey a sheet-shaped medium from one of the first accommodation part and the second accommodation part, and cause the recorder to record an image on the sheet-shaped medium being conveyed, the recording command including accommodation part information about an accommodation part and medium information about a sheet-shaped medium; and cause the conveyance mechanism to convey the second sheet-shaped medium from the second accommodation part, in a case where the accommodation part information indicates the first accommodation part, and the medium information indicates the second sheet-shaped medium.

2. The image recording apparatus according to claim 1, wherein the controller is configured to cause the conveyance mechanism to convey the first sheet-shaped medium from the first accommodation part, in a case where the accommodation part information indicates the second accommodation part and the medium information indicates the first sheet-shaped medium.

3. The image recording apparatus according to claim 1, wherein the controller is configured to cause the conveyance mechanism to convey the second sheet-shaped medium from the second accommodation part, in a case where the accommodation part information indicates the second accommodation part and the medium information indicates the first sheet-shaped medium.

4. The image recording apparatus according to claim 1, wherein the controller is configured to cause the conveyance mechanism to convey a sheet-shaped medium from one, which is indicated by the accommodation part information, of the first accommodation part and the second accommodation part, in a case where the medium information indicates whichever one of the first sheet-shaped medium and the second sheet-shaped medium is selected.

5. The image recording apparatus according to claim 1, wherein the controller is configured to cause the conveyance mechanism to convey a sheet-shaped medium from one, which is indicated by the accommodation part information, of the first accommodation part and the second accommodation part, in a case where the medium information is not included in the recording command.

6. The image recording apparatus according to claim 1, further comprising a memory configured to store priority information indicating which of the first accommodation part and the second accommodation part is to be given priority, wherein the controller is configured to cause the conveyance mechanism to convey a sheet-shaped medium from one, which corresponds to the priority information, of the first accommodation part and the second accommodation part, in a case where the medium information indicates whichever one of the first sheet-shaped medium and the second sheet-shaped medium is selected, and the accommodation part information indicates whichever one of the first accommodation part and the second accommodation part is selected.

7. The image recording apparatus according to claim 1, further comprising a memory configured to store priority information indicating which of the first accommodation part and the second accommodation part is to be given priority, wherein the controller is configured to cause the conveyance mechanism to convey a sheet-shaped medium from one, which corresponds to the priority information, of the first accommodation part and the second accommodation part, in a case where the medium information and the accommodation part information are not included in the recording command.

8. The image recording apparatus according to claim 1, wherein the first sheet-shaped medium has a first size, wherein the second sheet-shaped medium has a second size in which a length of the conveyance direction in the second size is longer than that in the first size, wherein the recording command further includes size information about a size of a sheet-shaped medium, and wherein the controller is configured to cause the conveyance mechanism to convey the second sheet-shaped medium from the second accommodation part, in a case where the size information indicates a size in which a length of the conveyance direction in the size is longer than that in the first size.

9. The image recording apparatus according to claim 8, wherein the controller is configured to cause the conveyance mechanism to convey the first sheet-shaped medium from the first accommodation part, in a case where the size information indicates a third size in which a length of the conveyance direction in the third size is shorter than that in the first size.

10. The image recording apparatus according to claim 9, wherein the conveyance mechanism includes a first pair of rollers and a second pair of rollers spaced apart from each other in the conveyance direction, and each of the first pair of rollers and the second pair of rollers rotate while sandwiching a sheet-shaped medium to convey the sheet-shaped medium in the conveyance direction, wherein the length of the conveyance direction in the first size is equal to or longer than an interval between the first pair of rollers and the second pair of rollers in the conveyance direction, and wherein the length of the conveyance direction in the third size is shorter than the interval between the first pair of rollers and the second pair of rollers in the conveyance direction.

11. The image recording apparatus according to claim 8, wherein the conveyance mechanism includes a first pair of rollers and a second pair of rollers spaced apart from each other in the conveyance direction, and each of the first pair of rollers and the second pair of rollers rotate while sandwiching a sheet-shaped medium to convey the sheet-shaped medium in the conveyance direction, wherein the image recording apparatus further comprises a cutter configured to cut a sheet-shaped medium conveyed by the conveyance mechanism in a direction intersecting with the conveyance direction, and wherein in a case where the size information indicates a third size in which a length of the conveyance direction in the third size is shorter than that of the first size and is equal to or longer than an interval between the first pair of rollers and the second pair of rollers in the conveyance direction, the controller is configured to create a sheet-shaped medium having a length in the conveyance direction corresponding to the third size, by causing the conveyance mechanism to convey the second sheet-shaped medium from the second accommodation part and causing the cutter to cut the second sheet-shaped medium.

12. An image recording apparatus comprising:

a first accommodation part configured to accommodate a plurality of first sheet-shaped mediums in a state where the plurality of first sheet-shaped mediums are stacked;

a second accommodation part configured to accommodate a second sheet-shaped medium in a state where the second sheet-shaped medium is rolled in a roll shape;

a conveyance mechanism configured to selectively convey a first sheet-shaped medium of the plurality of first sheet-shaped mediums and the second sheet-shaped medium;

a recorder configured to record an image on a sheet-shaped medium conveyed by the conveyance mechanism; and a controller configured to:

cause, based on a recording command, the conveyance mechanism to convey a sheet-shaped medium from one of the first accommodation part and the second accommodation part, and cause the recorder to record an image on the sheet-shaped medium being conveyed; and cause the conveyance mechanism to convey the second sheet-shaped medium from the second accommodation part, in a case where accommodation part information about an accommodation part included in the recording command indicates the first accommodation part, and medium information about a sheet-shaped medium included in the recording command indicates the second sheet-shaped medium.

13. An image recording apparatus comprising:

a conveyance mechanism configured to convey a sheet-shaped medium in a conveyance direction;

a recorder configured to record an image on the sheet-shaped medium conveyed by the conveyance mechanism; and a controller, wherein the conveyance mechanism is configured to selectively convey a first sheet-shaped medium accommodated in a first accommodation part, and a second sheet-shaped medium accommodated in a second accommodation part and longer than the first sheet-shaped medium in the conveyance direction, and wherein the controller is configured to:

cause, based on a recording command, the conveyance mechanism to convey a sheet-shaped medium from one of the first accommodation part and the second accommodation part, and cause the recorder to record an image on the sheet-shaped medium being conveyed;

cause the conveyance mechanism to convey the second sheet-shaped medium from the second accommodation part, in a case where accommodation part information about an accommodation part included in the recording command indicates the first accommodation part, and medium information about a sheet-shaped medium included in the recording command indicates the second sheet-shaped medium; and cause the conveyance mechanism to convey the second sheet-shaped medium from the second accommodation part, in a case where the accommodation part information indicates the second accommodation part and the medium information indicates the first sheet-shaped medium.

14. An image recording apparatus comprising:

a conveyance mechanism configured to convey a sheet-shaped medium in a conveyance direction;

a recorder configured to record an image on the sheet-shaped medium conveyed by the conveyance mechanism; and a controller, wherein the conveyance mechanism is configured to selectively convey a first sheet-shaped medium accommodated in a first accommodation part, and a second sheet-shaped medium accommodated in a second accommodation part and longer than the first sheet-shaped medium in the conveyance direction, and wherein the controller is configured to:

cause, based on a recording command, the conveyance mechanism to convey a sheet-shaped medium from one of the first accommodation part and the second accommodation part, and cause the recorder to record an image on the sheet-shaped medium being conveyed;

cause the conveyance mechanism to convey the second sheet-shaped medium from the second accommodation part, in a case where accommodation part information about an accommodation part included in the recording command indicates the first accommodation part, and medium information about a sheet-shaped medium included in the recording command indicates the second sheet-shaped medium; and cause the conveyance mechanism to convey a sheet-shaped medium from one, which is indicated by the accommodation part information, of the first accommodation part and the second accommodation part, in a case where the medium information is not included in the recording command.

15. An image recording apparatus comprising:

a conveyance mechanism configured to convey a sheet-shaped medium in a conveyance direction, the conveyance mechanism is configured to selectively convey a first sheet-shaped medium accommodated in a first accommodation part, and a second sheet-shaped medium accommodated in a second accommodation part and longer than the first sheet-shaped medium in the conveyance direction;

a recorder configured to record an image on the sheet-shaped medium conveyed by the conveyance mechanism;

a memory configured to store priority information indicating which of the first accommodation part and the second accommodation part is to be given priority; and a controller configured to:

cause, based on a recording command, the conveyance mechanism to convey a sheet-shaped medium from one of the first accommodation part and the second accommodation part, and cause the recorder to record an image on the sheet-shaped medium being conveyed;

cause the conveyance mechanism to convey the second sheet-shaped medium from the second accommodation part, in a case where accommodation part information about an accommodation part included in the recording command indicates the first accommodation part, and medium information about a sheet-shaped medium included in the recording command indicates the second sheet-shaped medium; and cause the conveyance mechanism to convey a sheet-shaped medium from one, which corresponds to the priority information, of the first accommodation part and the second accommodation part, in a case where the medium information and the accommodation part information are not included in the recording command.

16. An image recording apparatus comprising:

a conveyance mechanism configured to convey a sheet-shaped medium in a conveyance direction, the conveyance mechanism includes a first pair of rollers and a second pair of rollers spaced apart from each other in the conveyance direction, and each of the first pair of rollers and the second pair of rollers rotate while sandwiching the sheet-shaped medium to convey the sheet-shaped medium in the conveyance direction, the conveyance mechanism is configured to selectively convey a first sheet-shaped medium accommodated in a first accommodation part, and a second sheet-shaped medium accommodated in a second accommodation part and longer than the first sheet-shaped medium in the conveyance direction, the first sheet-shaped medium has a first size, and the second sheet-shaped medium has a second size in which a length of the conveyance direction in the second size is longer than that in the first size;

cutter configured to cut a sheet-shaped medium conveyed by the conveyance mechanism in a direction intersecting with the conveyance direction;

a recorder configured to record an image on the sheet-shaped medium conveyed by the conveyance mechanism; and a controller configured to:

cause, based on a recording command, the conveyance mechanism to convey a sheet-shaped medium from one of the first accommodation part and the second accommodation part, and cause the recorder to record an image on the sheet-shaped medium being conveyed;

cause the conveyance mechanism to convey the second sheet-shaped medium from the second accommodation part, in a case where accommodation part information about an accommodation part included in the recording command indicates the first accommodation part, and medium information about a sheet-shaped medium included in the recording command indicates the second sheet-shaped medium; and cause the conveyance mechanism to convey the second sheet-shaped medium from the second accommodation part, in a case where size information about a size of a sheet- shaped medium included in the recording command indicates a size in which a length of the conveyance direction in the size is longer than that in the first size, wherein in a case where the size information indicates a third size in which a length of the conveyance direction in the third size is shorter than that of the first size and is equal to or longer than an interval between the first pair of rollers and the second pair of rollers in the conveyance direction, the controller is configured to create a sheet-shaped medium having a length in the conveyance direction corresponding to the third size, by causing the conveyance mechanism to convey the second sheet-shaped medium from the second accommodation part and causing the cutter to cut the second sheet-shaped medium.

* * * * *